US005219015A

United States Patent [19]

Kraeutler

[11] Patent Number: 5,219,015

[45] Date of Patent: Jun. 15, 1993

[54] LIFTING CURTAIN DOOR

[75] Inventor: Bernard Kraeutler, Dunieres, France

[73] Assignee: Nergeco SA, Dunieres, France

[21] Appl. No.: 883,212

[22] Filed: May 14, 1992

Related U.S. Application Data

[63] Continuation-in-part of Ser. No. 745,984, Aug. 7, 1991, Pat. No. 5,141,043, which is a continuation of Ser. No. 524,894, May 18, 1990, abandoned.

[30] Foreign Application Priority Data

May 19, 1989 [FR] France ..... 89 06592
Jan. 2, 1990 [FR] France ..... 90 00001

[51] Int. Cl.[5] ..... E06B 9/17

[52] U.S. Cl. ..... 160/271; 160/264; 160/84.1

[58] Field of Search ..... 160/267.1, 272, 273.1, 160/84.1, 264, 271

[56] References Cited

U.S. PATENT DOCUMENTS

| | | | |
|---|---|---|---|
| 972,422 | 10/1910 | Whitmore | 160/267.1 X |
| 1,284,123 | 11/1918 | Masumian | 160/267.1 X |
| 1,694,314 | 12/1928 | Dixson | 160/273.1 |
| 1,779,646 | 10/1930 | Traut | 160/273.1 X |
| 1,786,054 | 12/1930 | Dixson | 160/273.1 |
| 2,094,932 | 10/1937 | Swan | 160/271 X |
| 4,478,268 | 10/1984 | Palmer | 160/272 X |
| 4,690,195 | 9/1987 | Taylor | 160/271 X |
| 4,880,045 | 11/1989 | Stahler | 160/84.1 |
| 5,025,847 | 6/1991 | Mueller | 160/265 X |
| 5,056,579 | 10/1991 | Krafutler | 160/264 X |
| 5,141,043 | 8/1992 | Kraeutler | 160/264 |

*Primary Examiner*—Blair M. Johnson
*Attorney, Agent, or Firm*—Sughrue, Mion, Zinn, Macpeak and Seas

[57] ABSTRACT

A lifting curtain industrial door including a flexible curtain capable of being gathered together at the top of the door by being rolled up or folded, and of being lowered in a plane between two vertical side uprights each including a slideway, each slideway having a guide wall on either side of the plane of the curtain, the curtain having lateral portions which slide in said slideways, said lateral portions being adapted to escape from the slideways in the event of an abnormal transverse force, wherein the wall of the upright including the slideway includes at least one moving wall element capable of deforming elastically so as to form a path enabling a lateral portion of the curtain to pass from the outside to the inside of the slideway, but not in the opposite direction.

8 Claims, 4 Drawing Sheets

FIG.5
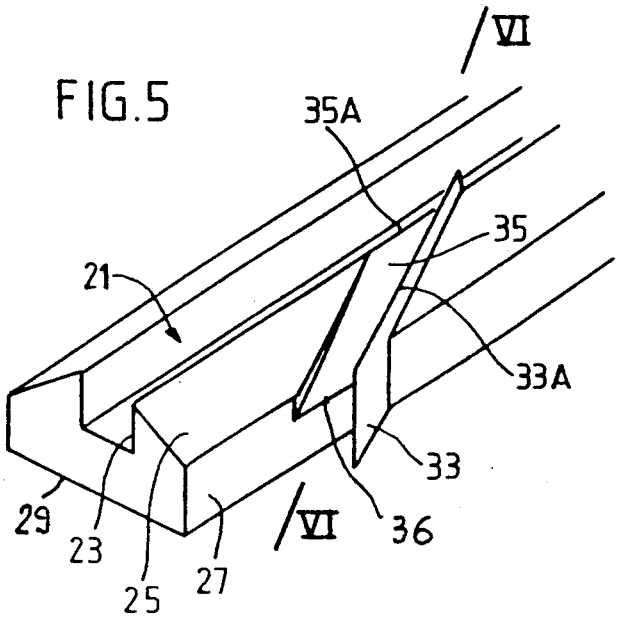
FIG.7
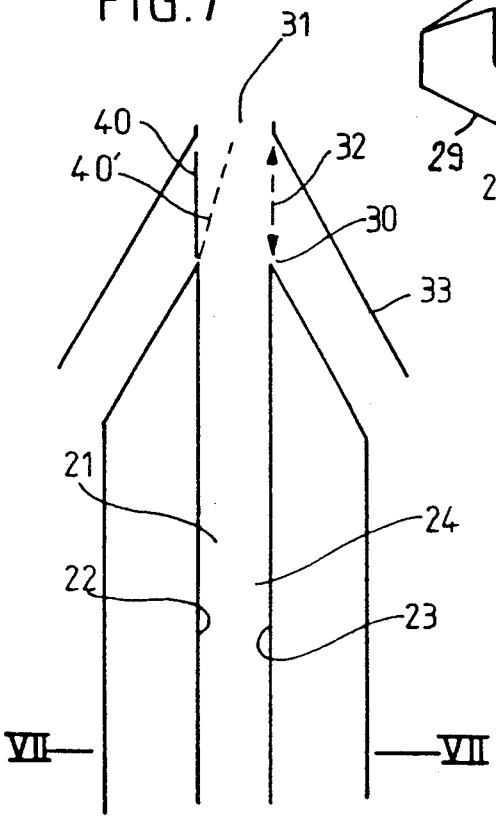
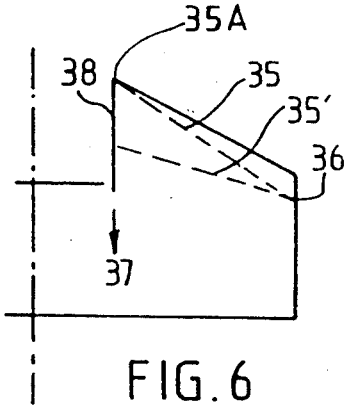
FIG.6
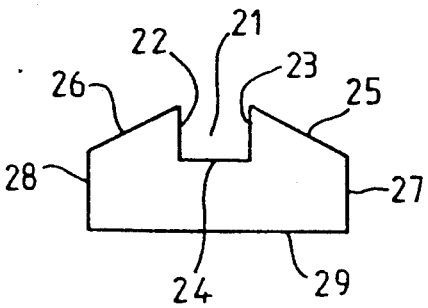
FIG.8

LIFTING CURTAIN DOOR

This is a continuation-in-part of application Ser. No. 07/745,984 filed Aug. 7, 1991, now U.S. Pat. No. 5,141,043, which is a continuation of Ser. No. 07/524,894 filed May 18, 1990, now abandoned.

The present invention relates to doors for industrial buildings and premises, hangars and warehouses, in which the industrial door is constituted by a flexible, semi-rigid, or rigid, curtain which is foldable or rollable and which opens a doorway by being raised, and which closes it by being lowered, with the curtain being stored at the top of the door when raised, either by being rolled up or by being folded.

BACKGROUND OF THE INVENTION

Some doors of this type are exposed to the action of the wind. Various means are known for preventing major deformation which could damage the door or jam it. The vertical edges of the curtain may have a portion of greater thickness or skids fixed thereon for sliding in a channel (like sails on a boat). Vertically spaced-apart horizontal reinforcing bars are also used with their ends sliding in slideways.

The present invention relates in particular to a an industrial door having a lifting curtain and including two vertical lateral uprights each constituting or including a slideway, each slideway having a guide wall on either side of the plane of the curtain, which curtain is capable of being gathered together at the top of the door by being rolled up or folded, the curtain having lateral portions which slide in said slideways, said lateral portions being adapted to escape from the slideways in the event of an abnormal transverse force. This prevents the curtain being damaged in the event of shock.

After said lateral portions of the curtain have escaped from the slideways, it is advantageous if the curtain returns to its normal position merely by being operated and without special action being taken. To do this, it is known, in particular from Documents U.S. Pat. Nos. 1,694,314, 1,786,054, and EP-0 272 733, to provide cutouts or windows in the slideways enabling the lateral edges of the curtain to be reinserted when the curtain is raised. Unfortunately, the lateral edges can also escape from the slideways through such windows while the curtain is being lowered, particularly if the curtain is being subjected to gusting wind. A particular object of the present invention is to remedy this drawback.

SUMMARY OF THE INVENTION

The present invention therefore provides a lifting-curtain industrial door including two vertical side uprights each constituting or including a slideway, each slideway having a guide wall on either side of the plane of the curtain, the curtain being capable of being gathered together at the top of the door by being rolled up or folded, the curtain having lateral portions which slide in said slideways, said lateral portions being adapted to escape from the slideways in the event of an abnormal transverse force, wherein the wall of the slideway or the wall of the upright including the slideway includes at least one moving wall element capable of deforming elastically so as to form a part enabling a lateral portion of the curtain to pass from the outside to the inside of the slideway, but not in the opposite direction.

In a first embodiment, the moving wall element is a shutter of a wall of the slideway, extending parallel to the plane of the curtain and movable about its bottom edge, and it moves towards the inside of the slideway between the two walls delimiting the normal sliding path for the lateral portions of the curtain.

In a second embodiment, the moving wall element is a shutter of an outside wall of an upright containing the slideway, in a plane that is oblique relative to the plane of the curtain, said shutter being movable about its outermost edge and moving towards the web of the slideway without interfering therewith, to form an access path with an opening in the slideway.

Advantageously, at least one of the outside walls of the uprights including the slideways is provided with a guide projecting from said wall and directed generally upwards towards the opening of the slideway, said guide extending over at least a portion of the width of said wall to the edge of the opening of the slideway so as to return into the slideway a lateral portion of the curtain that has escaped therefrom and that is being pulled upwards. The guide may extend from an end close to the curtain to an end that is distant from the curtain and that projects beyond the lateral wall of the upright.

The present invention also provides a lifting-curtain industrial door including two vertical side uprights each constituting or including a slideway, each slideway having a guide wall on either side of the plane of the curtain, the curtain being capable of being gathered together at the top of the door by being rolled up or folded, the curtain having lateral portions which slide in said slideways, said lateral portions being adapted to escape from the slideways in the event of an abnormal transverse force, wherein at least one of the outside walls of the uprights including the slideways is provided with a reinsertion ramp extending towards the inside of the door as it extends towards the opening of the slideway in such a manner as to return, into the slideway, a lateral portion of the curtain that has escaped therefrom and that is being pulled upwards, deforming it towards the inside of the door by bending or by contraction (e.g. telescopic shortening). Advantageously, said reinsertion ramp is provided with a guide projecting from the outside wall of the upright above said reinsertion ramp, said guide extending over at least a portion of the width of said wall to the edge of the opening of the slideway so as to hold a lateral portion of the curtain within said reinsertion ramp during reinsertion thereof into the slideway. Advantageously, said guide may extend from a near end of the curtain to a distant end of the curtain which projects beyond the lateral wall of the upright.

Advantageously, said slideway is limited in height to a level situated beneath the lowest bar when the curtain is raised, and presents an upwardly flared opening so that when the curtain is lowered from its raised position, said lateral portions of the curtain engage in the flared portion of the slideway.

BRIEF DESCRIPTION OF THE DRAWINGS

Embodiments of the invention are described by way of example with reference to the accompanying drawings, in which:

FIGS. 5 and 6 are a perspective view and a section through one embodiment of a slideway for a door of the invention;

FIGS. 7 and 8 are analogous to FIGS. 5 and 6 and relate to a variant door; and

DETAILED DESCRIPTION

Figure 1:
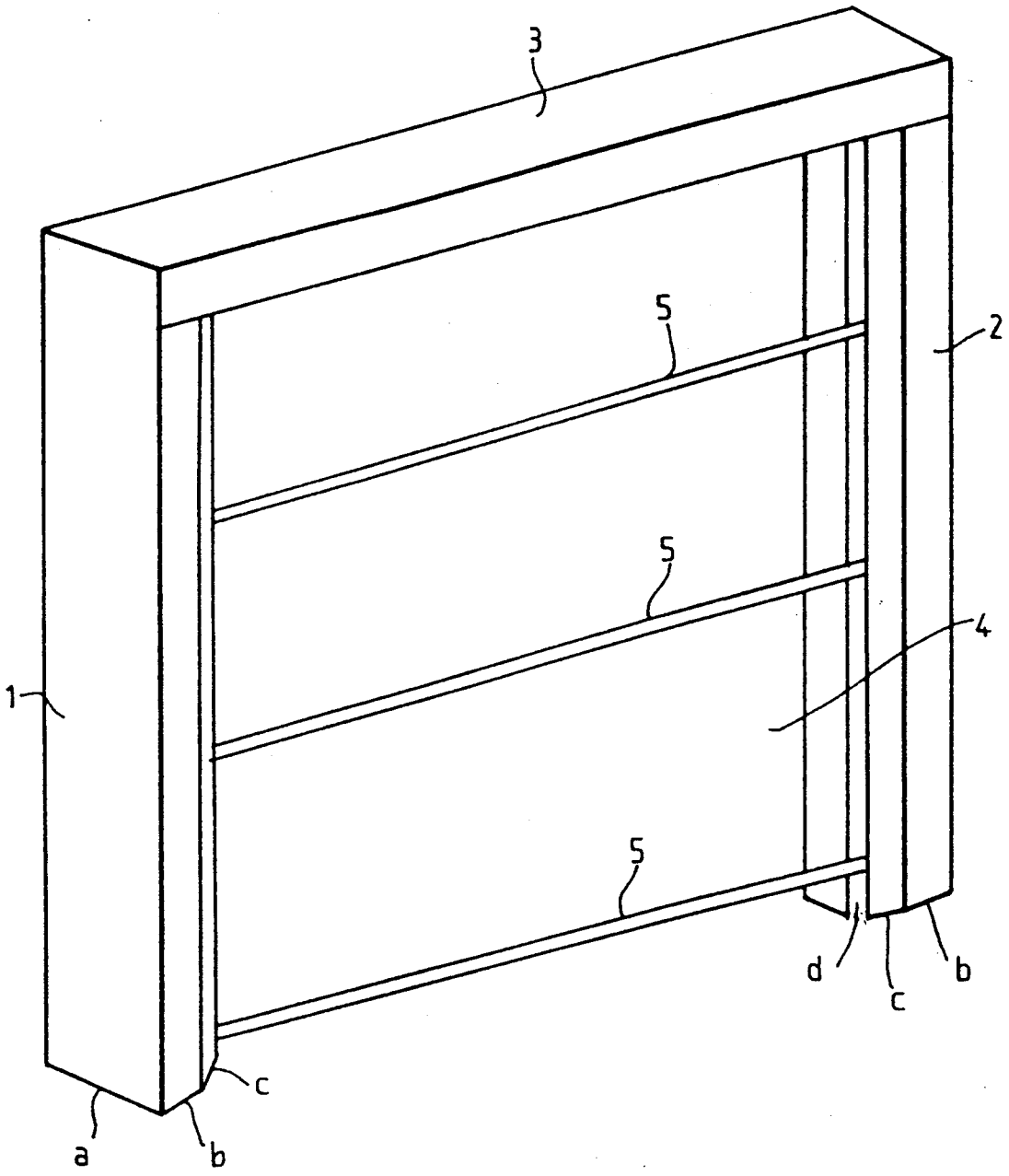
FIG. 1 is a perspective view of a door of the invention.

FIG. 1 is a perspective view of one embodiment of a door frame for a curtain type door of the invention. The frame comprises two vertical side uprights 1 and 2 interconnected at their top ends by a cross bar 3 constituting a lintel.

The cross section of each upright is in the form of a pentagon which is open at one of its vertices, having a base a, two sides b extending perpendicularly to the base, and two sides c extending towards each other and leaving a gap d between their adjacent ends, thereby forming the opening to a slideway 21 in each of the uprights and suitable for receiving a corresponding edge of the curtain 4 together with the ends of curtain reinforcing bars 5. Corresponding sides may be equal in size or otherwise. In order to make the drawings easier to understand, the curtain is assumed to be made of transparent material (which is possible in practice and is indeed done in some cases).

Figure 2:
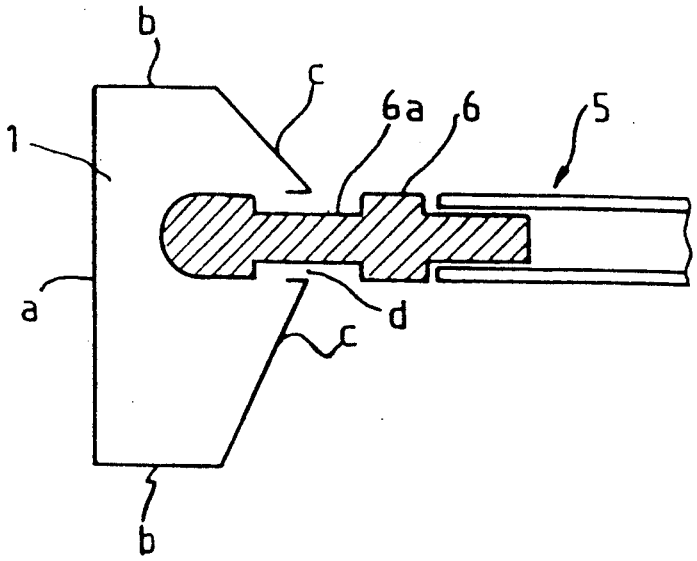
FIG. 2 is a section view on a horizontal plane through one of the uprights of the door shown in FIG. 1.

FIG. 2 is a horizontal section view through an upright and through one end of a curtain reinforcing bar, showing how the bar is disposed in the slideway.

According to the invention, the reinforcing bars are made sufficiently flexible that when subjected to thrust they are capable of leaving the guide groove prior to being subjected to permanent deformation or to subjecting the guide groove itself to permanent deformation. This may be obtained by the bar assembly being flexible. Flexibility may be provided by means of a glass fiber reinforced plastic tube capable of absorbing considerable non-permanent deformation so that one or both of its ends may leave the groove without permanent deformation or breakage. Flexibility may be limited to a portion of the bar, e.g. its middle, or to its ends. The middle of the bar may be constituted by a more flexible portion, e.g. a resilient sleeve or a coil spring, thereby enabling the bar to fold. The bar 5 may also be provided with endpieces 6 made of flexible material, e.g. rubber, which are engaged in the two ends of the bar which may then be a tube made of metal or any other material. The endpiece may be semirigid so as to withstand normal thrusts (wind) or thrusts slightly higher than normal, and may include a zone 6*a* of narrowing enabling it to bend in the event of a sudden thrust or a thrust which is very strong.

Figure 3:
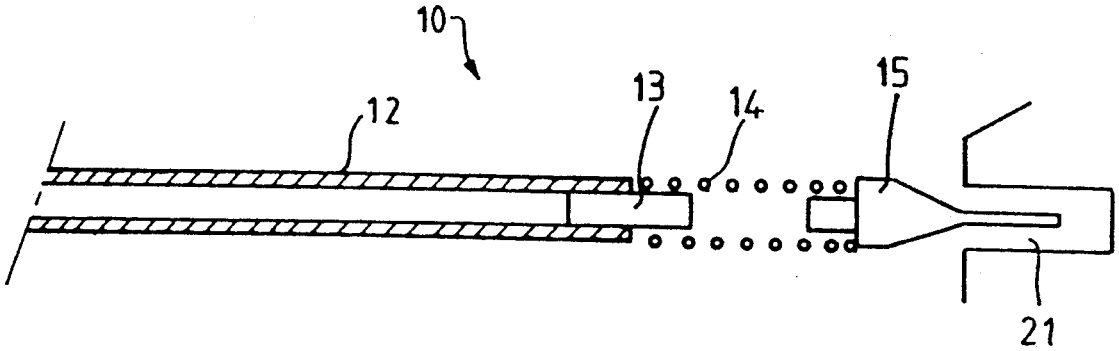
FIG. 3 shows a variant of the embodiment of FIG. 2.

FIG. 3 is a section through another embodiment of the end of a bar. The horizontal reinforcing bar 10 is constituted by a tube 12 with a mandrel 13 received in the end thereof, and with a spring 14 engaged on the mandrel. The dimensions of the mandrel and of the spring are selected so that these parts are capable of holding together without additional means merely by being pushed together as shown. It is preferable, although clearly not essential, to avoid any need for riveting, welding, etc. . . . operations. In a variant, the spring could be engaged inside the tube 12. Similarly, an endpiece 15 is fixed to the other end of the spring. Because of material wear and because of the need to reduce noise in operation, it is preferable to ensure that the spring does not rub directly against the slideway 21. It will readily be understood that if sufficiently large force is applied to the bar, then its end, i.e. the endpiece 15, may leave the slideway because the end of the bar deforms, i.e. because the spring 14 folds without being damaged. Conversely, after it has escaped from the slideway, the end of the bar is easily returned into the slideway, e.g. by applying adequate thrust or by manually folding over the endpiece 15 to cause it to penetrate back into the slideway.

Under such conditions, in the event of excessive force being applied to a door, the bars escape from the slideways because of the flexibility of the bars 5, 10.

Figure 4:
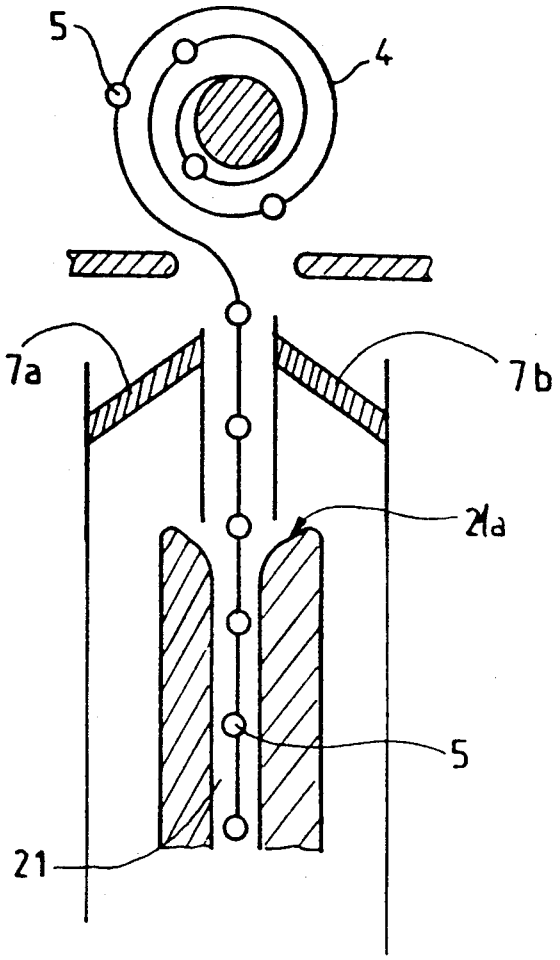
FIG. 4 is a section view on a vertical plane through a portion of the door shown in FIG. 1.

It is advantageous to avoid any need for manual intervention to put the system back into place. The directions in which the faces c of the uprights constituting the slideways extend facilitate reinserting the bars in the slideways while the curtain is being raised under the effect of upwards traction exerted on the bars by the curtain. It is also advantageous to provide complementary dispositions for forcing the ends of the bars to go back into the slideways. To this end, in an embodiment of the invention shown in FIG. 4 (which is a section view on a vertical plane perpendicular to the curtain 4 and taken in the middle thereof), the slideways 21 may come to an end a little below the volume in which the curtain is stored, e.g. by being rolled up as shown in section in the figure. The slideway ends may have upwardly flared ends 21*a* so that when the curtain is lowered again, the ends of the bar naturally engage in the slideways 21.

In order to facilitate returning the bar ends to their proper places while the curtain is being raised, reinsertion ramps or recentering surfaces 7*a* are provided above the flare of the slideway and beneath the curtain storage zone such that when the curtain is raised, the ends of the bars are returned to the axis of the curtain-storage zone.

The space between the flare 21*a* and the reinsertion ramp 7 forms a reinsertion window. A plurality of them may be provided up the height of the curtain.

The apparatus described above with reference to FIG. 4 has a gap in the slideway at each reinsertion ramp. While the curtain is being lowered and going past a gap, the wind may move it off axis so that it continues to go down outside the slideways. Such apparatus is therefore not suitable for being placed in locations that may be exposed to the wind or to large drafts.FIGS. 5 to 8 shown variant embodiments of the invention that avoid this limitation.

These variants all include a slideway 21 as described above. The slideway 21 is essentially defined by two parallel plane walls 22 and 23 on either side of the curtain plane, and delimiting an intersticial space in which the ends of the horizontal reinforcing bars of the curtain door move, said ends being guided by the walls 22 and 23. The bottom of the slideway groove may be closed by a wall 24, thereby improving stiffness and protecting the inside of the slideway from dust and other foreign bodies. According to a characteristic of the invention, the slideways are coated on the outsides of their sloping faces 25 and 26 (protective walls), thereby facilitating reinsertion of escaped bar ends back into the slideways. A slideway generally includes additional side walls 27 and 28 and a bottom wall 29 so as to constitute a rigid assembly.

Figure 9:
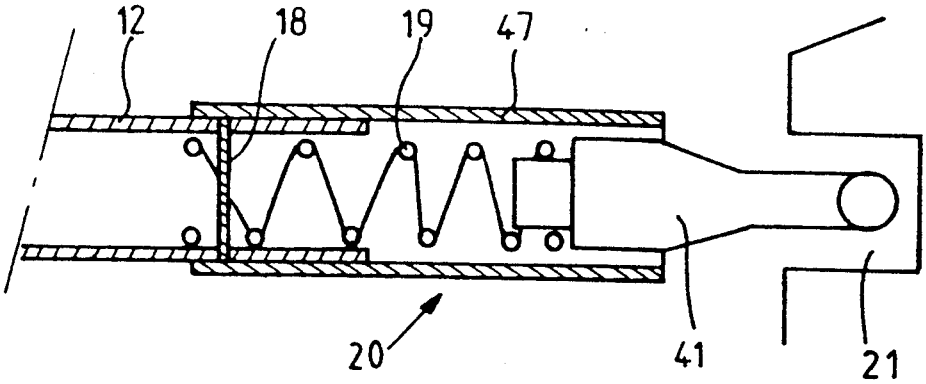
FIG. 9 is a section through the end of a reinforcing bar for a flexible curtain and specially designed to facilitate reinsertion of the curtain into its slideways after it has been removed therefrom by an abnormal force.

In the embodiment shown in part and in diagrammatic perspective in FIG. 5, the slideway 21 does not include any gaps. However a reinsertion ramp 35 is provided, preferably near the top of the door. When a bar has escaped from the slideway 21, then the end of the bar will rub against the surface 25 or 27 of the lateral upright including the slideway. On reaching the ramp 35, the end of the bar is engaged thereon by traction due to the curtain being raised, and also by the effect of the inclined guide 33. The end of the bar moves up the ramp 35 which causes the bar to shorten. This may be achieved by the bar bending, or if it is made as shown in FIG. 3 or 9, by a spring deforming or contracting. The end of the bar is guided to the end 35A of the ramp, after which it expands so as to return into the slideway 21. Since the slideway has no gaps, the bars are prevented from escaping from the slideway while the curtain is being lowered even if the curtain is subjected to strong wind.

In order to facilitate shortening the bar, so as to allow it to slide easily along the guide 33A, and so as to facilitate reinsertion into the slideway, the ends of the bars may be telescopic, as shown in FIG. 9 for the bar 20.

A sleeve 47 is mounted on the end of the tube 12, either by being force-fitted thereon or else by means of a pin 18 which simultaneously serves to hold the inside end of the spring 19 which urges a piston 41 outwards, the piston having a function equivalent to that of the endpiece 15 of the bar shown in FIG. 3. Unlike the previous example, the end of the bar need not be flexible. In order to enable the bar to escape from its slideways under the effect of an abnormal force, the bar must be flexible overall or else it must include a zone, e.g. a central zone, which is particularly flexible. However, once such a bar has escaped from the slideway, it can clearly be seen that it can be returned thereto by pushing the piston 41 into the sleeve 47, e.g. by hand or else while the curtain is being raised by virtue of a suitable guide ramp onto which the piston is directed during curtain raising. While the bar is being raised, the piston 41 is thrust by the ramp onto the tube 12 and is guided to the edge of the slideway. At this moment, the spring 19 is free to expand and the piston is reengaged in the slideway. It is then no longer capable of escaping therefrom merely by being lowered again.

In FIG. 5, the guide ramp is shown as being a small hollow relative to the sloping surface 25. This is not essential. The ramp may be constituted solely by the projecting rim 33A of the reinsertion guide. In this case, the guide may be fixed or displaceable or removable. In this case, the surface 25 may also be parallel to the bottom 29 of the slideway.

In a variant embodiment, in order to facilitate reinsertion of bars that are simpler in structure, the ramp 35 may be displaceable so as to temporarily open a window in the wall 23 of the slideway. For example, the ramp may be hinged about the bottom edge 36, and a section 38 of the wall 23 may be displaceable in the direction of arrow 37. FIG. 6 is a section on line VI—VI of FIG. 5, and shows the ramp in its normal position at reference 35, and in its pushed down position at reference 35'. The extent to which the slideway can be pushed down may be defined as a function of the nature of the bars and of the ease with which they bend or of their ability to shorten. In practice, this local mobility may be obtained by forming a cut-out in the wall of the upright.

In another embodiment of the invention, in order to prevent bars from escaping from the slideway while the curtain is being lowered, the reinsertion window 32 (righthand portion of FIG. 7) may be closed by a deformable or hinged shutter 40 (lefthand side of FIG. 7) which is urged when in its rest position to remain in a plane parallel to the curtain but which is capable of occupying a position 40' by deforming into the slideway under thrust from the end of a bar as pulled by the curtain being raised. Once the curtain has been gathered together at the top of the door, the shutter 40 returns to its position lying flush with the wall 22 of the slideway and the curtain may be lowered again without running any risk of it escaping from the slideway.

The shutter 40 may be a flexible metal blade fixed at one end by means of rivets. Alternatively it may be formed merely by forming a cut-out in the wall of the slideway, depending on the resilient nature of the material from which the slideway is made.

I claim:

1. A lifting-curtain industrial door including a flexible curtain capable of being gathered together at a top of the door, and of being lowered in a plane between two vertical side uprights each including a slideway, each slideway having a guide wall on either side of a plane of the curtain when lowered, the curtain having lateral portions which slide in said slideways, said lateral portions being adapted to escape from the slideways in the event of an abnormal transverse force, wherein a guide wall of the upright including the slideway includes at least one moving wall element capable of deforming elastically so as to form a path enabling a lateral portion of the curtain to pass from the outside to the inside of the slideway, but not in the opposite direction.

2. A door according to claim 1, wherein the moving wall element is a vertical wall shutter (40) of the slideway, parallel to the plane of the curtain and movable about a bottom edge of the shutter, and suitable for moving towards the inside of the slideway.

3. A door according to claim 1, wherein the moving wall element is a shutter 35 of an outside wall of an upright including the slideway, lying in a plane that is oblique relative to the plane of the curtain, said shutter being movable about an edge thereof furthest from the plane of the curtain and moving towards a web of the slideway without interfering therewith to form an access path with an opening into the slideway.

4. A door according to claim 1, wherein at least one outer wall of each upright is provided with a guide (33) projecting from said outer wall and generally upwardly directed towards the slideway, said guide extending over at least a portion of the width of said outer wall to an edge of the slideway so as to return into the slideway a lateral portion of a curtain that has escaped therefrom and that is being pulled upwards.

5. A lifting-curtain industrial door including a flexible curtain capable of being gathered together at a top of the door, and of being lowered in a plane between two vertical side uprights each including a slideway, each slideway having a guide wall on either side of a plane of the curtain when lowered, the curtain having lateral portions which slide in said slideways, said lateral portions being adapted to escape from the slideways in the event of an abnormal transverse force, wherein at least one of the outside walls of the uprights including the slideways is provided with a reinsertion ramp (35) which forms a hollow, secondary slideway relative to the surface of the outside walls of the uprights, said reinsertion ramp being oblique relative to the plane of the curtain and directed generally upwards towards the slideway, said reinsertion ramp extending towards an inside of the door as it extends toward the slideway, in such a manner as to return, into the slideway during the upwards movement of the curtain, a lateral portion of the curtain that has escaped therefrom and that is being pulled upwards by slidably engaging a lateral portion of the curtain in the secondary slideway, with the curtain being deformed towards the inside of the door.

6. A door according to claim 5, further wherein said reinsertion ramp is provided with a guide (33) projecting from the outside wall of the upright above said reinsertion ramp, said guide extending over at least a portion of the width of said wall to an edge of the slideway so as to hold the lateral portion of the curtain in said reinsertion ramp during reinsertion thereof into the slideway.

7. A door according to claim 3, wherein at least one outer wall of each upright is provided with a guide (33) projecting from said outer wall and generally upwardly directed towards the slideway, said guide extending over at least a portion of the width of said outer wall to an edge of the slideway so as to return into the slideway a lateral portion of a curtain that has escaped therefrom and that is being pulled upwards, and said guide being disposed alongside said shutter.

8. A lifting-curtain industrial door including a flexible curtain capable of being gathered together at a top of the door, and of being lowered in a plane between two vertical side uprights each including a slideway, each slideway having a guide wall on either side of a plane of the curtain when lowered, the curtain having lateral portions which slide in said slideways, said lateral portions being adapted to escape from the slideways in the event of an abnormal transverse force, wherein at least one of the outside walls of the uprights including the slideways is provided with a guide (33) projecting from the outside wall of the upright adjacent to the guide walls of said slideway, said guide being oblique relative to the plane of the curtain and directed generally upwards towards the slideway, said guide extending towards the inside of the door as it extends toward the slideway, and over at least a portion of the width of said outside wall to an edge of the slideway, in such a manner as to return, into the slideway, during the upwards movement of the curtain, a lateral portion of the curtain that has escaped therefrom, so as to hold said lateral portion of the curtain against said guide during reinsertion thereof into the slideway.

* * * * *